US009664146B2

(12) United States Patent
Matsunaga et al.

(10) Patent No.: US 9,664,146 B2
(45) Date of Patent: May 30, 2017

(54) APPARATUS FOR SUPPRESSING FUEL EVAPORATIVE GAS EMISSION

(71) Applicant: Mitsubishi Jidosha Kogyo Kabushiki Kaisha, Tokyo (JP)

(72) Inventors: Hideo Matsunaga, Okazaki (JP); Hisakazu Ikedaya, Okazaki (JP); Hitoshi Kamura, Okazaki (JP)

(73) Assignee: MITSUBISHI JIDOSHA KOGYO KABUSHIKI KAISHA, Tokyo (JP)

( * ) Notice: Subject to any disclaimer, the term of this patent is extended or adjusted under 35 U.S.C. 154(b) by 600 days.

(21) Appl. No.: 14/139,345

(22) Filed: Dec. 23, 2013

(65) Prior Publication Data

US 2014/0174411 A1 Jun. 26, 2014

(30) Foreign Application Priority Data

Dec. 26, 2012 (JP) ..... 2012-282670

(51) Int. Cl.
*F02M 25/08* (2006.01)

(52) U.S. Cl.
CPC .... *F02M 25/0854* (2013.01); *F02M 25/0809* (2013.01); *F02M 25/0818* (2013.01); *F02M 25/0836* (2013.01)

(58) Field of Classification Search
CPC ..... F02M 25/0809; F02M 25/0818; F02M 25/0827; F02M 25/0854; F02M 25/08; F02D 41/003; F02D 41/0032; F02D 41/0037; F02D 41/004
See application file for complete search history.

(56) References Cited

U.S. PATENT DOCUMENTS 5,499,614 A * 3/1996 Busato ..... F02M 25/0809 123/198 D
5,542,397 A * 8/1996 Takahata ..... F02M 25/0809 123/520
5,590,634 A * 1/1997 Shinohara ..... F02M 25/0809 123/198 D
5,817,925 A * 10/1998 Cook ..... F02M 25/0818 123/520

(Continued)

FOREIGN PATENT DOCUMENTS

JP 2004156498 A * 6/2004
JP 2004-301027 A 10/2004
JP 4151382 B2 9/2008

*Primary Examiner* — Erick Solis
*Assistant Examiner* — Anthony L Bacon
(74) *Attorney, Agent, or Firm* — Birch, Stewart, Kolasch & Birch, LLP

(57) ABSTRACT

A changeover valve is opened, reference pressure Pb is detected, a monitoring timer is set to 0, a purge process is started, the changeover valve is closed, a pump is operated, and the monitoring timer t is started. Then, a canister internal pressure Pc is detected, a pressure deviation ΔPc is calculated from the reference pressure Pb and the canister pressure Pc, and it is determined if there is abnormality such as a leak or obstruction in a fuel evaporative gas treatment portion when the pressure deviation ΔPc is a first threshold ΔP1 or higher. It is determined that there is a leak when the pressure deviation ΔPc is less than a second threshold ΔP2, and it is determined that there is an obstruction when the pressure deviation ΔPc is the second threshold ΔP2 or higher.

5 Claims, 6 Drawing Sheets

(56) References Cited

U.S. PATENT DOCUMENTS

| | | | | |
|---|---|---|---|---|
| 6,089,080 | A * | 7/2000 | Takaku | F02M 25/0809 123/520 |
| 6,722,187 | B2 * | 4/2004 | Grieve | F02M 25/0809 73/114.38 |
| 9,151,251 | B2 * | 10/2015 | Matsunaga | F02M 25/0809 |
| 2004/0089062 | A1 * | 5/2004 | Matsubara | F02M 25/0818 73/114.41 |
| 2006/0059979 | A1 * | 3/2006 | Matsubara | F02M 25/089 73/114.39 |
| 2013/0008414 | A1 * | 1/2013 | Matsunaga | F02M 25/0836 123/519 |
| 2013/0008415 | A1 * | 1/2013 | Matsunaga | F02M 25/0836 123/520 |

* cited by examiner

APPARATUS FOR SUPPRESSING FUEL EVAPORATIVE GAS EMISSION

BACKGROUND OF THE INVENTION

Field of the Invention

The present invention relates to an apparatus for suppressing fuel evaporative gas emission, and more particularly to control for detecting an abnormality of the apparatus for suppressing fuel evaporative gas emission.

Description of the Related Art

Conventionally, in order to prevent emission of a fuel evaporative gas evaporated in a fuel tank into the atmosphere, an apparatus for suppressing fuel evaporative gas emission is provided including: a canister mounted in a purge passage that provides communication between a fuel tank and an intake passage of an internal combustion engine; a changeover valve that opens or closes the canister to or from the atmosphere; a sealing valve that provides communication or closes between the fuel tank and the canister; and a purge solenoid valve that provides communication of and interrupts the purge passage. The apparatus for suppressing fuel evaporative gas emission opens the changeover valve and the sealing valve and closes the purge solenoid in fueling so that the fuel evaporative gas flows toward the canister, and the fuel evaporative gas is adsorbed to activated carbon provided in the canister. The apparatus for suppressing fuel evaporative gas emission opens the changeover valve and the purge solenoid valve in operation of the internal combustion engine, and discharges the fuel evaporative gas adsorbed to the activated carbon in the canister to the intake passage of the internal combustion engine to treat the fuel evaporative gas. The apparatus for suppressing fuel evaporative gas emission also detects a leak from the apparatus in order to prevent the fuel evaporative gas from leaking outside the apparatus.

For leak detection, in a conventional vehicle that travels with a drive force of an internal combustion engine, opening/closing of a changeover valve, a sealing valve, and a purge solenoid valve is controlled in operation of the internal combustion engine, a negative pressure is generated in a purge passage and a fuel tank by a negative pressure generated in an intake passage of the internal combustion engine, and a leak is determined by whether the negative pressure is held or not to detect presence or absence of a leak.

However, in a vehicle such as a plug-in hybrid vehicle that includes an internal combustion engine and also an electric motor, and travels mainly with a drive force of the electric motor, the internal combustion engine is rarely operated in order to improve fuel efficiency, and if a leak in the apparatus for suppressing fuel evaporative gas emission is to be detected in operation of the internal combustion engine, there are few opportunities for leak detection.

Thus, an apparatus for suppressing fuel evaporative gas emission provided in a vehicle with limited operation of an internal combustion engine includes a negative pressure pump that can reduce a pressure in the apparatus for suppressing fuel evaporative gas emission, and controls operation of the negative pressure pump, and opening/closing of a changeover valve, a sealing valve, and a purge solenoid valve during key-off of the vehicle to detect a leak in the apparatus for suppressing fuel evaporative gas emission (Japanese Patent No. 4151382).

In the apparatus for treating evaporative fuel of an internal combustion engine in Japanese Patent No. 4151382, a negative pressure pump unit is provided on an atmosphere open side of the canister.

Such a negative pressure pump unit includes a movable component in the negative pressure pump unit and has a gap, thereby preventing complete closing between an atmosphere side and a canister side.

Thus, for example, if a purge process is performed of discharging a fuel evaporative gas in the fuel tank or a fuel evaporative gas adsorbed to the canister to the intake passage of the internal combustion engine in operation of the internal combustion engine, and a negative pressure in the intake passage of the internal combustion engine is used to detect an abnormality such as a leak or an obstruction in the purge passage of the apparatus for treating evaporative fuel, the atmosphere flows into the canister from the atmosphere side of the negative pressure pump unit, which makes it difficult to accurately detect a leak or an obstruction in the purge passage. Also, the atmosphere flows into the canister from the atmosphere side of the negative pressure pump unit, and thus, unpreferably it takes time to generate a negative pressure necessary for detecting an abnormality such as a leak or an obstruction in the purge passage or the canister.

SUMMARY OF THE INVENTION

The present invention is achieved to solve such problems, and has an object to provide an apparatus for suppressing fuel evaporative gas emission that can detect an abnormality in a short time.

To achieve the above described object, the present invention provides an apparatus for suppressing fuel evaporative gas emission, including: a fuel evaporative gas treatment portion including a communication path that provides communication between an intake passage of an internal combustion engine and a fuel tank, a canister provided to communicate with the communication path, and a communication path opening/closing unit for opening/closing communication between the communication path and the intake passage; a negative pressure generation unit for generating a negative pressure in the canister via a communication hole that provides communication between inside and outside of the canister; a pressure detection unit for detecting an internal pressure of the canister; and a control unit for performing a purge process by opening the communication path opening/closing unit during operation of the internal combustion engine to purge the fuel evaporative gas in the fuel tank and the canister to the intake passage, and performing, during the purge process and after the negative pressure generation unit is operated, abnormality detection of the fuel evaporative gas treatment portion based on a detection result of the pressure detection unit.

According to the present invention, the communication path opening/closing unit is opened in operation of the internal combustion engine, and in the purge process of purging the fuel evaporative gas in the fuel tank and the canister to the intake passage, the negative pressure generation unit is operated, and an abnormality of the fuel evaporative gas treatment portion is detected based on the detection result of the pressure detection unit.

Thus, the negative pressure generation unit is operated to prevent air from flowing through a gap between components of the negative pressure generation unit from an atmosphere side to a canister side, and thus a predetermined negative pressure can be early generated in the fuel evaporative gas treatment portion, thereby allowing detection of an abnormality of the fuel evaporative gas treatment portion in a short time.

Also, for example, if the internal pressure of the canister is a negative pressure that can be generated by the negative pressure generation unit in abnormality detection of the fuel evaporative gas treatment portion, the internal pressure of the canister is not an internal pressure generated by a negative pressure in the intake passage. Thus, it can be determined that there is an obstruction on an intake passage side of the pressure detection unit of the fuel evaporative gas treatment portion.

Thus, an abnormality such as a leak or an obstruction of the fuel evaporative gas treatment portion can be detected in a short time.

BRIEF DESCRIPTION OF THE DRAWINGS

The present invention will become more fully understood from the detailed description given hereinafter and the accompanying drawings which are given by way of illustration only, and thus, are not limitative of the present invention, and wherein.

DETAILED DESCRIPTION OF THE INVENTION

Now, an embodiment of the present invention will be described with reference to the drawings.

Figure 1:
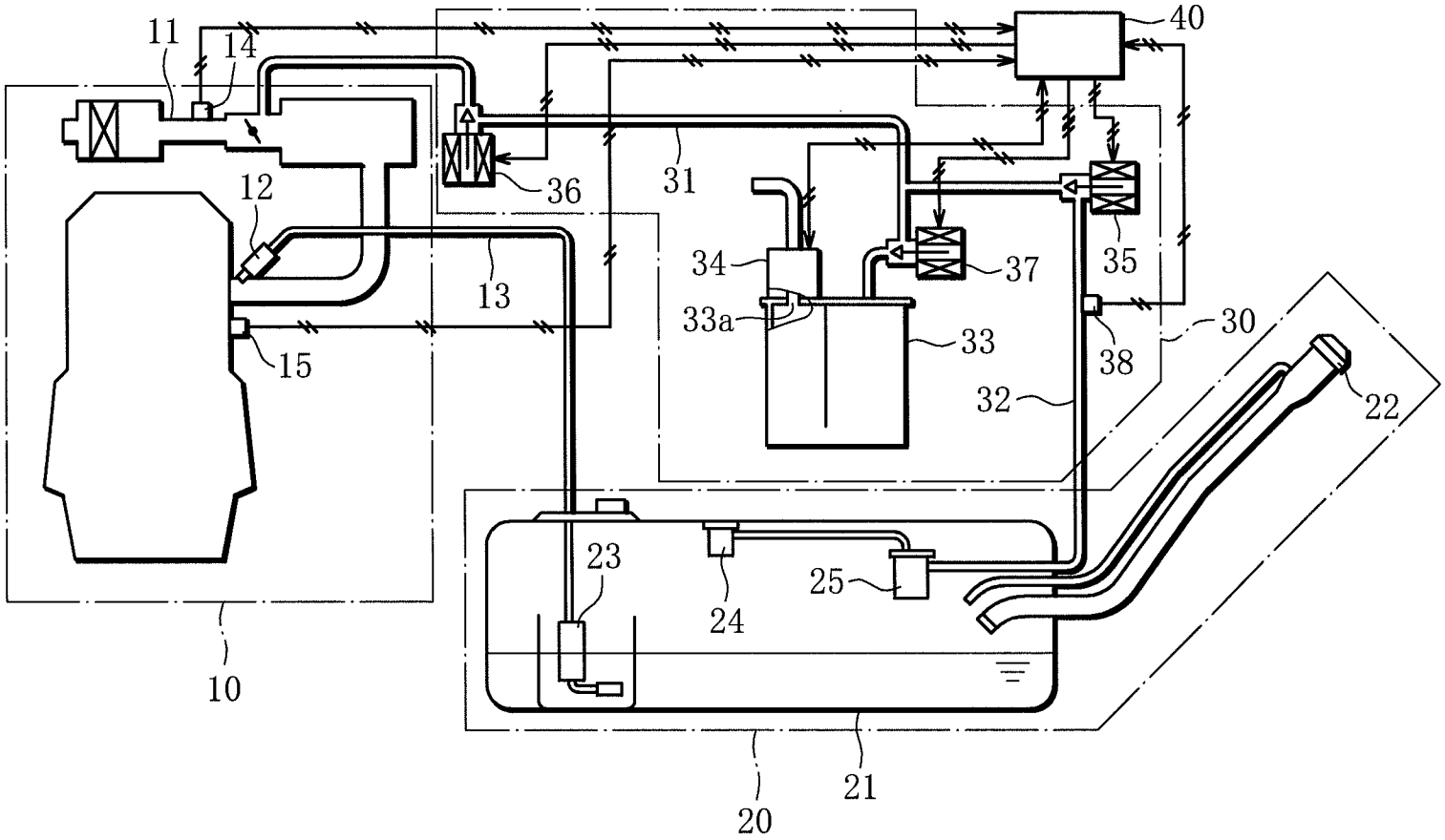
FIG. 1 is a schematic diagram of an apparatus for suppressing fuel evaporative gas emission according to the present invention.
Figure 2:
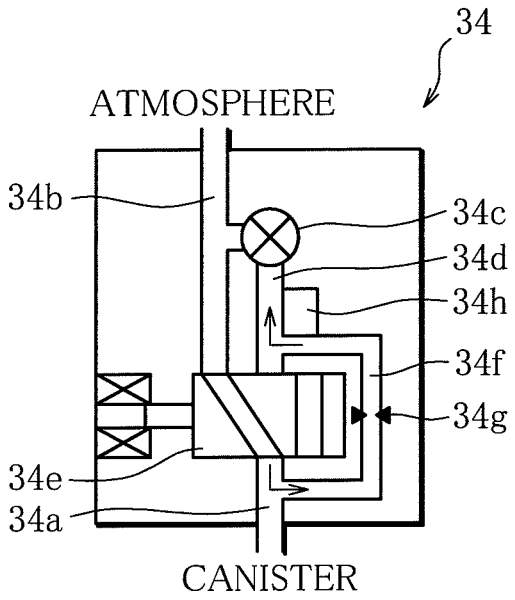
FIG. 2 shows an operation of an internal component when a changeover valve of an evaporative leak check module is not operated.
Figure 3:
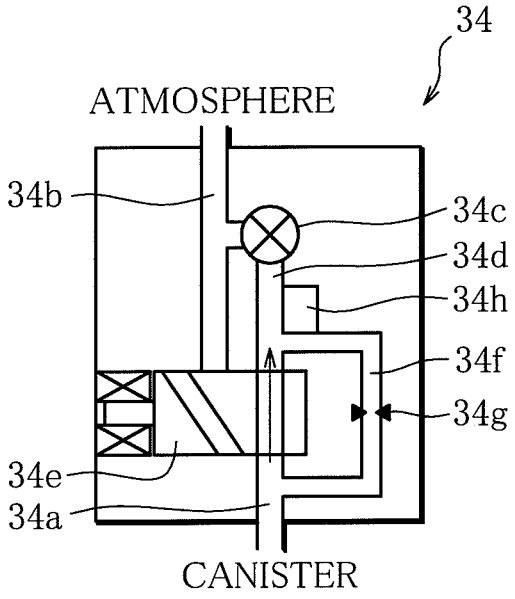
FIG. 3 shows an operation of the internal component when the changeover valve of the evaporative leak check module is operated.

FIG. 1 is a schematic diagram of an apparatus for suppressing fuel evaporative gas emission according to the present invention. FIG. 2 shows an operation of an internal component when a changeover valve of an evaporative leak check module is not operated, and FIG. 3 shows an operation of the internal component when the changeover valve of the evaporative leak check module is operated. Arrows in FIGS. 2 and 3 show a flow direction of air when a negative pressure pump described later is operated in a shown state. The changeover valve is opened when not operated as in FIG. 2, and closed when operated as in FIG. 3. A configuration of the apparatus for suppressing fuel evaporative gas emission will be described below.

The apparatus for suppressing fuel evaporative gas emission according to the present invention is used for a hybrid vehicle that includes a traveling motor and an engine (internal combustion engine) (not shown), and uses any one or both thereof to travel.

As shown in FIG. 1, the apparatus for suppressing fuel evaporative gas emission according to the present invention mainly includes an engine 10 provided in the vehicle, a fuel storage portion 20 that stores fuel, a fuel evaporative gas treatment portion 30 that treats an evaporative gas of the fuel evaporated in the fuel storage portion 20, and an electronic control unit 40 that is a control device for generally controlling the vehicle.

The engine 10 is a four-cycle in-line four-cylinder gasoline engine of an intake passage injection type (Multi Point Injection: MPI). The engine 10 includes an intake passage 11 that takes in air into a combustion chamber in the engine 10. A fuel injection valve 12 that injects fuel into an intake port of the engine 10 is provided downstream of the intake passage 11. A fuel pipe 13 is connected to the fuel injection valve 12, and fuel is supplied from a fuel tank 21 that stores the fuel.

An intake air temperature sensor 14 that detects a temperature of intake air is provided in the intake passage 11 of the engine 10. A water temperature sensor 15 that detects a temperature of cooling water for cooling the engine 10 is provided in the engine 10.

The fuel storage portion 20 includes the fuel tank 21, a fuel fill opening 22 that is a fuel inlet to the fuel tank 21, a fuel pump 23 that supplies the fuel from the fuel tank 21 via the fuel pipe 13 to the fuel injection valve 12, a fuel cutoff valve 24 that prevents the fuel from flowing from the fuel tank 21 to the fuel evaporative gas treatment portion 30, and a leveling valve 25 that controls a fuel level in the fuel tank 21 in fueling. The evaporative gas of the fuel generated in the fuel tank 21 is discharged from the fuel cutoff valve 24 via the leveling valve 25 to the fuel evaporative gas treatment portion 30.

The fuel evaporative gas treatment portion 30 includes a purge pipe (communication path) 31, a vapor pipe (communication path) 32, a canister 33, an evaporative leak check module 34, a sealing valve 35, a purge solenoid valve (a communication path opening/closing unit) 36, a bypass solenoid valve 37, and a pressure sensor (a pressure detection unit) 38.

The purge pipe 31 provides communication between the intake passage 11 of the engine 10 and the canister 33.

The vapor pipe 32 provides communication between the leveling valve 25 of the fuel tank 21 and the purge pipe 31. Specifically, the vapor pipe 32 provides communication between the fuel tank 21 and the purge pipe 31.

The canister 33 includes activated carbon therein. Also, the purge pipe 31 is connected to the canister 33 so that the fuel evaporative gas generated in the fuel tank 21 or the fuel evaporative gas adsorbed to the activated carbon can flow therethrough. The canister 33 also has an atmosphere hole (communication hole) **33*a* through which outside air is sucked when the fuel evaporative gas adsorbed to the activated carbon is discharged to the intake passage 11 of the engine 10**.

As shown in FIGS. 2 and 3, the evaporative leak check module 34 includes a canister-side passage 34*a* communicating with the atmosphere hole 33*a* in the canister 33 and an atmosphere-side passage 34*b* communicating with the atmosphere. The atmosphere-side passage 34*b* communicates with a pump passage 34*d* including a negative pressure pump (a negative pressure generation unit) 34*c*. The evaporative leak check module 34 also includes a changeover valve (a switching unit) 34*e* and a bypass passage 34*f*. The changeover valve 34*e* includes an electromagnetic solenoid, and is driven by the electromagnetic solenoid. As shown in FIG. 2, the changeover valve 34*e* provides communication between the canister-side passage 34*a* and the atmosphere-side passage 34*b* when the electromagnetic solenoid is not energized (OFF) (corresponding to an open state of the changeover valve 34*e*). As shown in FIG. 3, the changeover valve 34*e* provides communication between the canister-side passage 34*a* and the pump passage 34*d* when a drive signal is supplied from outside to the electromagnetic solenoid and the electromagnetic solenoid is energized (ON) (corresponding to a closed state of the changeover valve 34*e*). The bypass passage 34*f* is a passage that normally provides conduction between the canister-side passage 34*a* and the pump passage 34*d*. The bypass passage 34*f* has a reference orifice 34*g* of a small diameter (for example, a diameter of 0.45 mm). Between the negative pressure pump 34*c* in the pump passage 34*d* and the reference orifice 34*g* in the bypass passage 34*f*, a pressure sensor (a pressure detection unit) 34*h* is provided that detects a pressure in the pump passage 34*d* or the bypass passage 34*f* downstream of the reference orifice 34*g*. A negative pressure that can be generated in the fuel evaporative gas treatment portion 30 by the negative pressure pump 34*c* is set to be smaller than a negative pressure generated in the fuel evaporative gas treatment portion 30 by a negative pressure generated in the intake passage 11 of the engine 10 in operation of the engine 10.

The pressure sensor 34*h* detects a canister internal pressure that is an internal pressure of the canister 33. The pressure sensor 34*h* can detect internal pressures of the canister 33, the purge pipe 31 from the canister 33 to the purge solenoid valve 36, the vapor pipe 32, and the fuel tank 21 when the changeover valve 34*e* is closed, the canister-side passage 34*a* communicates with the pump passage 34*d*, the purge solenoid valve 36 is closed, and the sealing valve 35 and the bypass solenoid valve 37 are opened.

The sealing valve 35 is mounted in the vapor pipe 32 between the fuel tank 21 and the purge pipe 31. The sealing valve 35 includes an electromagnetic solenoid, and is driven by the electromagnetic solenoid. The sealing valve 35 is a normally closed electromagnetic valve that is closed when the electromagnetic solenoid is not energized (OFF), and opened when a drive signal is supplied from outside to the electromagnetic solenoid and the electromagnetic solenoid is energized (ON). The sealing valve 35 closes the vapor pipe 32 when the electromagnetic solenoid is not energized (OFF) and is closed, and opens the vapor pipe 32 when the drive signal is supplied from outside to the electromagnetic solenoid and the electromagnetic solenoid is energized (ON) and opened. Specifically, the sealing valve 35, when closed, seals the fuel tank 21, and prevents the fuel evaporative gas generated in the fuel tank 21 from flowing to the canister 33 or the intake passage 11 of the engine 10, while, when opened, allows the fuel evaporative gas to flow to the canister 33 or the intake passage 11 of the engine 10.

The purge solenoid valve 36 is mounted in the purge pipe 31 between the intake passage 11 and a connecting portion between the purge pipe 31 and the vapor pipe 32. The purge solenoid valve 36 includes an electromagnetic solenoid, and is driven by the electromagnetic solenoid. The purge solenoid valve 36 is a normally closed electromagnetic valve that is closed when the electromagnetic solenoid is not energized (OFF), and opened when a drive signal is supplied from outside to the electromagnetic solenoid and the electromagnetic solenoid is energized (ON). The purge solenoid valve 36 closes the purge pipe 31 when the electromagnetic solenoid is not energized (OFF) and is closed, and opens the purge pipe 31 when the drive signal is supplied from outside to the electromagnetic solenoid and the electromagnetic solenoid is energized (ON) and opened. Specifically, the purge solenoid valve 36, when closed, prevents the fuel evaporative gas from flowing from the canister 33 or the fuel tank 21 to the intake passage 11 of the engine 10, and, when opened, allows the fuel evaporative gas to flow from the canister 33 or the fuel tank 21 to the intake passage 11 of the engine 10.

The bypass solenoid valve 37 is mounted in the purge pipe 31 between the connecting portion between the purge pipe 31 and the vapor pipe 32 and the canister 33. The bypass solenoid valve 37 includes an electromagnetic solenoid, and is driven by the electromagnetic solenoid. The bypass solenoid valve 37 is a normally open electromagnetic valve that is opened when the electromagnetic solenoid is not energized (OFF), and closed when a drive signal is supplied from outside to the electromagnetic solenoid and the electromagnetic solenoid is energized (ON). The bypass solenoid valve 37 opens the canister 33 to the purge pipe 31 when the electromagnetic solenoid is not energized (OFF) and is opened, and closes the canister 33 when the drive signal is supplied from outside to the electromagnetic solenoid and the electromagnetic solenoid is energized (ON) and closed. Specifically, the bypass solenoid valve 37, when closed, seals the canister 33 and prevents the fuel evaporative gas from flowing to or from the canister 33. The bypass solenoid valve 37, when opened, allows the fuel evaporative gas to flow to or from the canister 33.

The pressure sensor 38 is provided in the vapor pipe 32 between the fuel tank 21 and the sealing valve 35. The pressure sensor 38 detects a tank internal pressure that is an internal pressure of the fuel tank 21. The pressure sensor 38 can detect the internal pressure of only the fuel tank 21 when the sealing valve 35 is closed and the fuel tank 21 is sealed.

The electronic control unit 40 is a control device for generally controlling the vehicle, and includes an input/output device, a storage device (ROM, RAM, non-volatile RAM, or the like), a central processing unit (CPU), a timer, or the like.

To an input side of the electronic control unit 40, the intake air temperature sensor 14, the water temperature sensor 15, the pressure sensor 34*h*, and the pressure sensor 38 are connected, and detection information from these sensors are input.

On the other hand, to an output side of the electronic control unit 40, the fuel injection valve 12, the fuel pump 23, the negative pressure pump 34*c*, the changeover valve 34*e*, the sealing valve 35, the purge solenoid valve 36, and the bypass solenoid valve 37 are connected.

The electronic control unit 40 controls operation of the negative pressure pump 34*c*, and opening/closing of the changeover valve 34*e*, the sealing valve 35, the purge solenoid valve 36, and the bypass solenoid valve 37 based on detection information from the various sensors, and performs purge process control (corresponding to a purge process in the present invention) for the fuel evaporative gas generated in the fuel tank 21 to be adsorbed to the canister 33, or to open the purge solenoid valve 36 in operation of the engine 10 and discharge the fuel evaporative gas adsorbed to the canister 33 or the fuel evaporative gas generated in the fuel tank 21 to the intake passage 11 of the engine 10. The electronic control unit 40 performs abnormality detection control of the fuel evaporative gas treatment portion 30 that detects a leak or an obstruction in the fuel evaporative gas treatment portion 30 during the purge process in operation of the engine 10.

The abnormality detection control of the fuel evaporative gas treatment portion 30 by the electronic control unit 40 thus configured according to the present invention will be described. The abnormality detection control of the fuel evaporative gas treatment portion 30 is performed in operation of the engine 10. During the abnormality detection control of the fuel evaporative gas treatment portion 30, the bypass solenoid valve 37 is always not energized (OFF). Specifically, during the abnormality detection control of the fuel evaporative gas treatment portion 30, the bypass solenoid valve 37 is always opened. During the abnormality detection control of the fuel evaporative gas treatment portion 30, the sealing valve 35 may be closed or opened.

Figure 4:
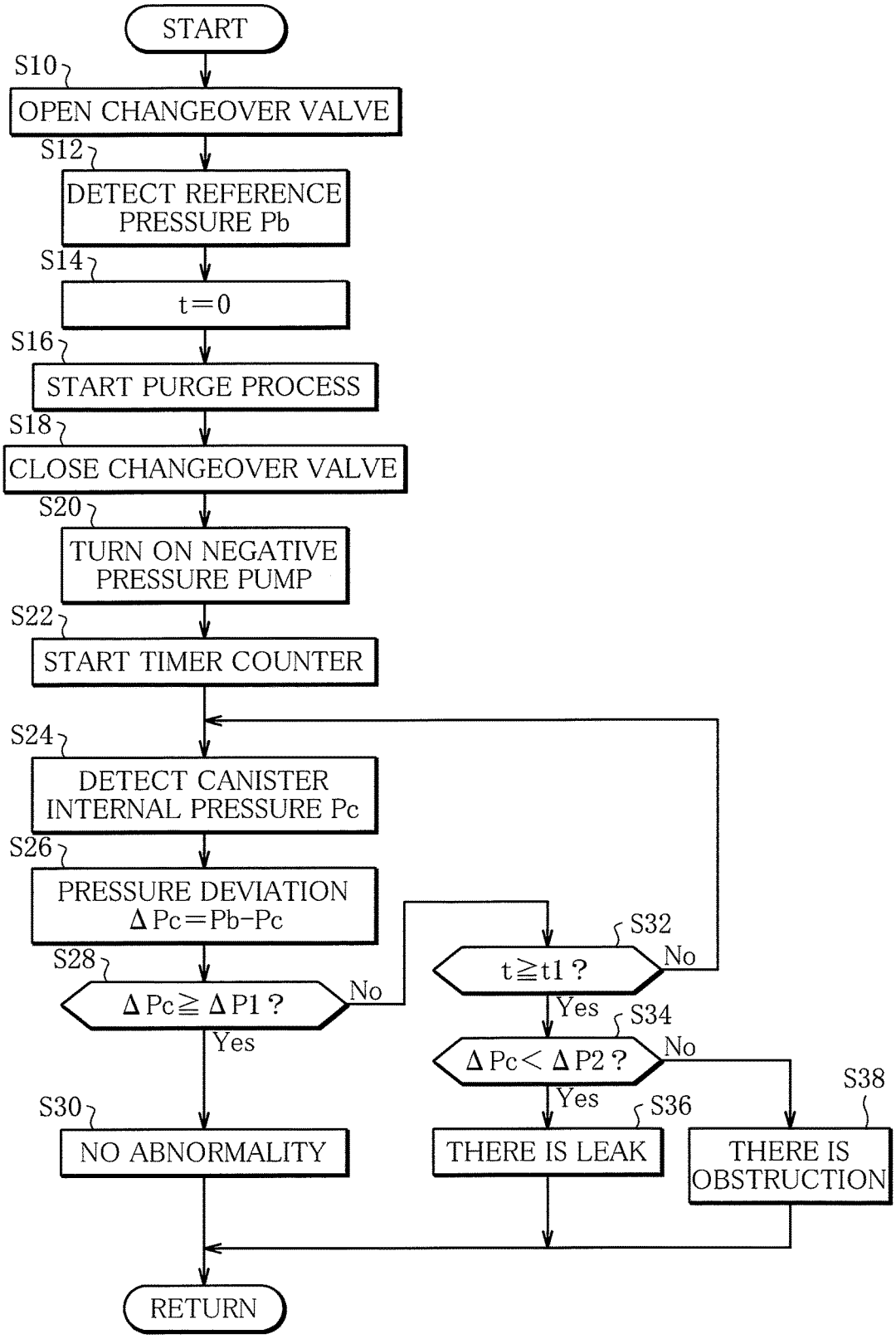
FIG. 4 is a control flowchart of abnormality detection control of a fuel evaporative gas treatment portion performed by an electronic control unit according to the present invention.
Figure 5:
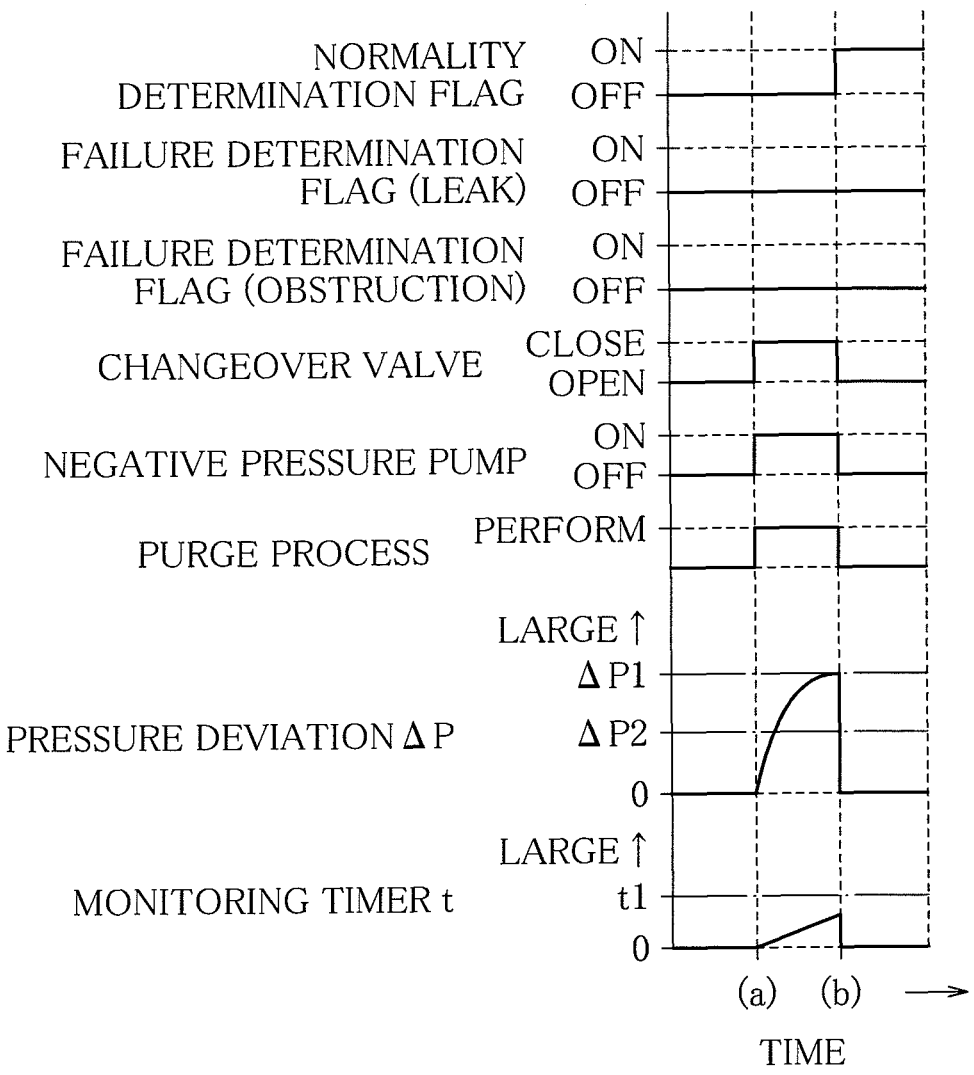
FIG. 5 chronologically shows operations of the changeover valve and a negative pressure pump in the abnormality detection control of the fuel evaporative gas treatment portion, presence or absence of performance of a purge process, and transition of a pressure deviation and flags, when the fuel evaporative gas treatment portion is normal.
Figure 6:
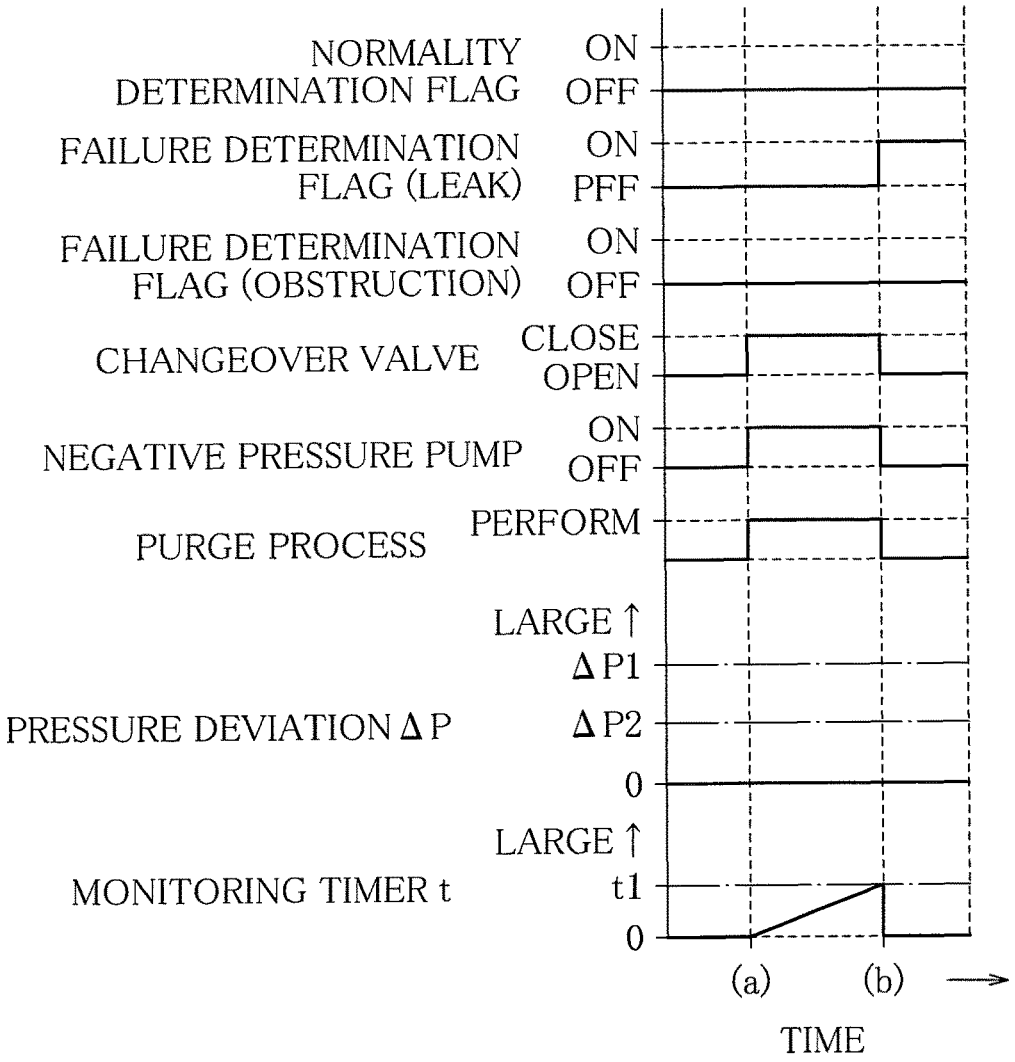
FIG. 6 chronologically shows operations of the changeover valve and the negative pressure pump in the abnormality detection control of the fuel evaporative gas treatment portion, presence or absence of performance of the purge process, and transition of a pressure deviation and flags, when there is a leak in the fuel evaporative gas treatment portion.
Figure 7:
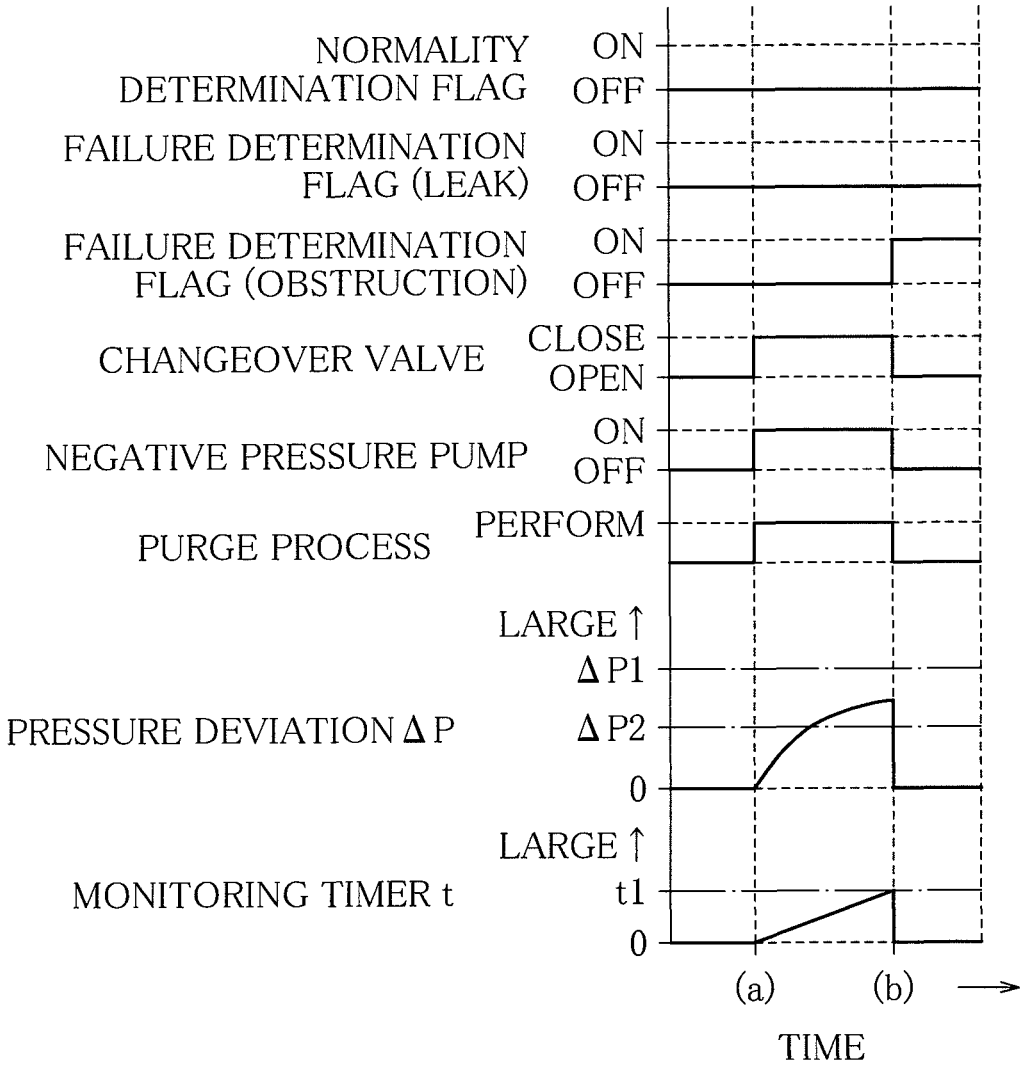
FIG. 7 chronologically shows operations of the changeover valve and the negative pressure pump in the abnormality detection control of the fuel evaporative gas treatment portion, presence or absence of performance of the purge process, and transition of a pressure deviation and flags, when there is an obstruction in the fuel evaporative gas treatment portion.

FIG. 4 is a control flowchart of the abnormality detection control of the fuel evaporative gas treatment portion 30 performed by the electronic control unit 40. FIG. 5 chronologically shows operations of the changeover valve 34*e* and the negative pressure pump 34*c* in the abnormality detection control of the fuel evaporative gas treatment portion 30, presence or absence of performance of the purge process, and transition of a pressure deviation ΔP and flags, when the fuel evaporative gas treatment portion 30 is normal. FIGS. 6 and 7 chronologically show operations of the changeover valve 34*e* and the negative pressure pump 34*c* in the abnormality detection control of the fuel evaporative gas treatment portion 30, presence or absence of performance of the purge process, and transition of a pressure deviation ΔP and flags, when there is a leak in the fuel evaporative gas treatment portion 30, and when there is an obstruction in the fuel evaporative gas treatment portion 30, respectively. In FIGS. 5 to 7, ΔP1 denotes a first threshold ΔP1. ΔP2 denotes a second threshold ΔP2. t1 denotes a predetermined time t1. The first threshold ΔP1 is determined based on a negative pressure generated in the fuel evaporative gas treatment portion 30 by a negative pressure generated in the intake passage 11 in operation of the engine 10. The second threshold ΔP2 is determined based on a negative pressure generated in the fuel evaporative gas treatment portion 30 by the operation of the negative pressure pump 34*c*. Specifically, the second threshold ΔP2 is determined by operating capacity of the negative pressure pump 34*c*. Since the negative pressure pump 34*c* itself degrades with time, the second threshold ΔP2 may be changed according thereto. The predetermined time t1 is appropriately set to a time or longer required for the pressure deviation ΔP to reach the second threshold ΔP2 or higher by the negative pressure pump 34*c*. The first threshold ΔP1, the second threshold ΔP2, and the predetermined time t1 are previously set by an experiment, an analysis, or the like.

As shown in FIGS. 4, 5, 6 and 7, in Step S10, the changeover valve 34*e* is opened. More specifically, if the changeover valve 34*e* is not opened, supply of a drive signal from outside to the electromagnetic solenoid of the changeover valve 34*e* is stopped to de-energize the electromagnetic solenoid (OFF), thereby opening the changeover valve 34*e*. Also, if the changeover valve 34*e* is opened at start of the abnormality detection control of the fuel evaporative gas treatment portion 30, the state is maintained. The changeover valve 34*e* is opened to introduce the atmosphere into the fuel evaporative gas treatment portion 30 so that a pressure in the fuel evaporative gas treatment portion 30 corresponds to an atmospheric pressure. Then, the process proceeds to Step S12.

In Step S12, a reference pressure Pb is detected. More specifically, the pressure sensor 34*h* detects a canister internal pressure that is an internal pressure of the canister 33, and sets the canister internal pressure to the reference pressure Pb. In Step S12, the changeover valve 34*e* is opened, and the canister internal pressure corresponds to the atmospheric pressure, and thus the reference pressure Pb corresponds to the atmospheric pressure. Then, the process proceeds to Step S14.

In Step S14, a monitoring timer t is set to 0. Then, the process proceeds to Step S16.

In Step S16, the purge process control is started. More specifically, a drive signal is supplied from outside to the electromagnetic solenoid of the purge solenoid valve 36 to energize the electromagnetic solenoid (ON), the purge solenoid valve 36 is opened, the fuel tank 21, the purge pipe 31, the vapor pipe 32, and the canister 33 are caused to communicate with the intake passage 11 of the engine 10, and the fuel evaporative gas in the canister 33 or the fuel tank 21 is discharged to the intake passage 11 by the negative pressure in the intake passage 11 ((a) in FIGS. 5, 6 and 7). Then, the process proceeds to Step S18.

In Step S18, a drive signal is supplied from outside to the electromagnetic solenoid of the changeover valve 34*e* to energize the electromagnetic solenoid (ON), and the changeover valve 34*e* is closed ((a) in FIGS. 5, 6 and 7). Then, the process proceeds to Step S20.

In Step S20, the negative pressure pump 34*c* is operated ((a) in FIGS. 5, 6 and 7). Then, the process proceeds to Step S22.

In Step S22, counting by the monitoring timer t is started. Then, the process proceeds to Step S24.

In Step S24, a canister internal pressure (post-operation pressure) Pc is detected. More specifically, the pressure sensor 34*h* detects the canister internal pressure Pc that is an internal pressure of the canister 33. Then, the process proceeds to Step S26.

In Step S26, a pressure deviation ΔPc is calculated. More specifically, the canister internal pressure Pc detected in Step S24 is subtracted from the reference pressure Pb to calculate a pressure deviation ΔPc. Then, the process proceeds to Step S28.

In Step S28, it is determined whether the pressure deviation ΔPc is the first threshold ΔP1 or not. When the determination result is true (Yes) and the pressure deviation ΔPc is the first threshold ΔP1 or higher, the process proceeds to Step S30 (FIG. 5(*b*)). When the determination result is false (No) and the pressure deviation ΔPc is less than the first threshold ΔP1, the process proceeds to Step S32.

In Step S30, it is determined that there is no abnormality such as a leak or an obstruction in the fuel evaporative gas treatment portion 30. More specifically, a pressure in the canister 33 is a negative pressure such that the pressure deviation ΔPc is the first threshold ΔP1 or higher by the negative pressure generated in the intake passage 11 in operation of the engine 10. Thus, the pressure in the fuel evaporative gas treatment portion 30 communicating with the canister 33 is a negative pressure such that the pressure deviation ΔPc is the first threshold ΔP1 or higher by the negative pressure generated in the intake passage 11 in operation of the engine 10. Thus, since the negative pressure such that the pressure deviation ΔPc is the first threshold ΔP1 or higher can be applied in the fuel evaporative gas treatment portion 30, it is determined that there is no leak or obstruction in the fuel evaporative gas treatment portion 30 to turn on a normality determination flag. Then, the purge process is finished, the negative pressure pump 34*c* is stopped, supply of the drive signal from outside to the electromagnetic solenoid of the changeover valve 34*e* is stopped to de-energize the electromagnetic solenoid (OFF), and the changeover valve 34*e* is opened (FIG. 5(*b*)). Then, this routine is returned.

In Step S32, it is determined whether or not the monitoring timer t indicates a predetermined time t1 or longer. When the determination result is true (Yes), the monitoring timer t indicates the predetermined time t1 or longer, and the predetermined time t1 has passed in the monitoring timer t, the process proceeds to Step S34. When the determination result is false (No), the monitoring timer t indicates less than the predetermined time t1, and the predetermined time t1 has not passed in the monitoring timer t, the process returns to Step S24.

In Step S34, it is determined whether the pressure deviation ΔPc is less than a second threshold ΔP2 or not. When the determination result is true (Yes) and the pressure deviation ΔPc is less than the second threshold ΔP2, the process proceeds to Step S36 (FIG. 6(*b*)). When the determination result is false (No) and the pressure deviation ΔPc is the second threshold ΔP2 or higher, the process proceeds to Step S38 (FIG. 7(*b*)).

In Step S36, it is determined that there is a leak in the fuel evaporative gas treatment portion 30. More specifically, even after a lapse of the predetermined time t from the start of counting by the monitoring timer t, a pressure in the canister 33 is not the negative pressure generated in the intake passage 11 in operation of the engine 10 or a negative pressure such that the pressure deviation ΔPc is the second threshold ΔP2 or higher by operation of the negative pressure pump 34*c*, but is a negative pressure such that the pressure deviation ΔPc is less than the second threshold ΔP2. Thus, a pressure in the fuel evaporative gas treatment portion 30 communicating with the canister 33 is not the negative pressure generated in the intake passage 11 in operation of the engine 10 or the negative pressure such that the pressure deviation ΔPc is the second threshold ΔP2 or higher by operation of the negative pressure pump 34*c*, but is the negative pressure such that the pressure deviation ΔPc is less than the second threshold ΔP2. Thus, since the negative pressure such that the pressure deviation ΔPc is the second threshold ΔP2 or higher cannot be applied in the fuel evaporative gas treatment portion 30, it is determined that there is a leak in the fuel evaporative gas treatment portion 30 to turn on a failure determination flag (leak). Then, the purge process is finished, the negative pressure pump 34*c* is stopped, supply of the drive signal from outside to the electromagnetic solenoid of the changeover valve 34*e* is stopped to de-energize the electromagnetic solenoid (OFF), and the changeover valve 34*e* is opened (FIG. 6(*b*)). Then, this routine is returned.

In Step S38, it is determined that there is an obstruction in the fuel evaporative gas treatment portion 30. More specifically, even after a lapse of the predetermined time t from the start of counting by the monitoring timer t, a pressure in the canister 33 is not the negative pressure generated in the intake passage 11 in operation of the engine 10 or the negative pressure such that the pressure deviation ΔPc is the first threshold ΔP1 or higher by operation of the negative pressure pump 34*c*, but is the negative pressure such that the pressure deviation ΔPc is the second threshold ΔP2 or higher and less than the first threshold ΔP1. Thus, a pressure in the fuel evaporative gas treatment portion 30 communicating with the canister 33 is not the negative pressure generated in the intake passage 11 in operation of the engine 10 or the negative pressure such that the pressure deviation ΔPc is the first threshold ΔP1 or higher by operation of the negative pressure pump 34*c*, but is the negative pressure such that the pressure deviation ΔPc is the second threshold ΔP2 or higher and less than the first threshold ΔP1. Thus, since the negative pressure such that the pressure deviation ΔPc is the first threshold ΔP1 or higher cannot be applied in the fuel evaporative gas treatment portion 30, it is determined that there is an obstruction in the fuel evaporative gas treatment portion 30 to turn on a failure determination flag (obstruction). Then, the purge process is finished, the negative pressure pump 34*c* is stopped, supply of the drive signal from outside to the electromagnetic solenoid of the changeover valve 34*e* is stopped to de-energize the electromagnetic solenoid (OFF), and the changeover valve 34*e* is opened (FIG. 7(*b*)). Then, this routine is returned.

As such, as shown in FIG. 4, the changeover valve 34*e* is opened to detect the reference pressure Pb in the apparatus for suppressing fuel evaporative gas emission according to the present invention. Then, the monitoring timer t is set to 0, the purge process is started, and the changeover valve 34*e* is closed. Then, the negative pressure pump 34*c* is operated and counting by the monitoring timer t is started. Then, the canister internal pressure Pc is detected, the canister internal pressure Pc is subtracted from the reference pressure Pb to calculate the pressure deviation ΔPc. Then, if the pressure deviation ΔPc is the first threshold ΔP1 or higher determined based on the negative pressure generated in the fuel evaporative gas treatment portion 30 by the negative pressure generated in the intake passage 11 in operation of the engine 10, it is determined that there is no abnormality such as a leak or an obstruction in the fuel evaporative gas treatment portion 30. If the monitoring timer t indicates the predetermined time t1 or longer and the predetermined time t1 has passed in the monitoring timer t, it is determined whether or not the pressure deviation ΔPc is less than the second threshold ΔP2. Then, it is determined whether the pressure deviation (Pc is less than the second threshold ΔP2 or not) determined based on the negative pressure generated in the fuel evaporative gas treatment portion 30 by operation of the negative pressure pump 34*c*. Then, when the pressure deviation ΔPc is less than the second threshold ΔP2, it is determined that there is a leak in the fuel evaporative gas treatment portion 30. When the pressure deviation ΔPc is the second threshold ΔP2 or higher, it is determined that there is an obstruction in the fuel evaporative gas treatment portion 30.

Thus, the first threshold ΔP1 is set to a value such that the internal pressure of the canister 33 is the pressure deviation ΔP obtained by the negative pressure in the intake passage 11 in operation of the engine 10, and the second threshold ΔP2 is set to a value such that the internal pressure of the canister 33 is the pressure deviation ΔP obtained by only the negative pressure by the negative pressure pump 34*c*. Thus, if the pressure deviation ΔP does not reach the second threshold ΔP2, the pressure in the fuel evaporative gas treatment portion 30 is not the negative pressure that can be generated by the negative pressure in the intake passage 11 and the negative pressure by the negative pressure pump 34*c*, and the atmosphere is sucked at anywhere in the fuel evaporative gas treatment portion 30. Specifically, it can be determined that there is a leak in the fuel evaporative gas treatment portion 30. Also, when the pressure deviation ΔP is less than the first threshold ΔP1 and the second threshold ΔP2 or higher, the pressure in the fuel evaporative gas treatment portion 30 is the negative pressure that can be generated by the negative pressure pump 34*c*, and is not influenced by the negative pressure in the intake passage 11, and it can be determined that there is an obstruction between the pressure sensor 34*h* in the fuel evaporative gas treatment portion 30 and the intake passage 11.

Thus, the two thresholds: the first threshold ΔP1 and the second threshold ΔP2 can be used to reliably detect an obstruction and a leak in the fuel evaporative gas treatment portion 30.

Also, the negative pressure pump 34*c* is operated during the purge process in abnormality determination of the fuel evaporative gas treatment portion 30 to prevent air from flowing through a gap between components of the negative pressure pump 34*c* from an atmosphere side to a side of the canister 33, and thus a negative pressure can be early generated in the fuel evaporative gas treatment portion 30, thereby allowing detection of an abnormality of the fuel evaporative gas treatment portion 30 in a short time.

Since the changeover valve 34*e* is opened to open the canister 33 to the atmosphere before setting the reference pressure Pb, opening the canister 33 to the atmosphere allows the reference pressure Pb to correspond to the atmospheric pressure, thereby allowing accurate calculation of the pressure deviation ΔP.

Thus, the pressure deviation ΔP can be accurately calculated, thereby allowing accurate determination of a leak and an obstruction in the fuel evaporative gas treatment portion 30.

The description on the embodiment of the present invention is now finished, but the embodiment of the present invention is not limited to the above described embodiment.

In the above described embodiment, the abnormality of the fuel evaporative gas treatment portion 30 is detected based on the pressure deviation ΔPc between the reference pressure Pb and the tank internal pressure Pc, the first threshold ΔP1, and the second threshold ΔP2, but not limited to this, for example, an absolute value of the tank internal pressure Pc may be used to detect an abnormality of the fuel evaporative gas treatment portion 30 without using the reference pressure Pb, that is, without using the pressure deviation ΔPc.

In the above described embodiment, the vehicle is the hybrid vehicle, but not limited to this, the apparatus for suppressing fuel evaporative gas emission including the evaporative leak check module 34 can determine an abnormality of the fuel evaporative gas treatment portion 30, and may be obviously applied to a vehicle that travels only using an engine.

What is claimed is:

1. An apparatus for suppressing fuel evaporation gas emission comprising:

a fuel evaporative gas treatment portion including a communication path that provides communication between an intake passage of an internal combustion engine and a fuel tank, a canister provided to communicate with the communication path, and a communication path opening/closing unit for opening/closing communication between the communication path and the intake passage;

a negative pressure generation unit for generating negative pressure in the canister via a communication hole that provides communication between inside and outside of the canister;

a pressure detection unit for detecting an internal pressure of the canister; and a control unit for performing a purge process by opening the communication path opening/closing unit during operation of the internal combustion engine to purge the fuel evaporative gas in the fuel tank and the canister to the intake passage, and performing, during the purge process and after the negative pressure generation unit is operated, abnormality detection of the fuel evaporative gas treatment portion based on a detection result of the pressure detection unit.

2. The apparatus for suppressing fuel evaporation gas emission according to claim 1, wherein the control unit sets the internal pressure of the canister before the purge process to a reference pressure, sets the internal pressure of the canister after operation of the negative pressure generation unit to a post-operation pressure, calculates a pressure deviation from the reference pressure and the post-operation pressure, determines that there is an obstruction in the fuel evaporative gas treatment portion when the pressure deviation is less than a first threshold, and is equal to or higher than a second threshold, the second threshold being set lower than the first threshold, and determines that there is a leak in the fuel evaporative gas treatment portion when the pressure deviation is less than the second threshold.

3. The apparatus for suppressing fuel evaporation gas emission according to claim 2, wherein the second threshold is changed based on operating capacity of the negative pressure generation unit.

4. The apparatus for suppressing fuel evaporation gas emission according to claim 2, further comprising:

a switching unit provided in the communication hole so as to switch communication between the negative pressure generation unit being in communication with the canister, and the canister being in communication with atmosphere, wherein the control unit controls operation of the switching unit before setting the reference pressure to open the canister to the atmosphere, and controls the operation of the switching unit at start of the purge process to provide communication between the negative pressure generation unit and the canister.

5. The apparatus for suppressing fuel evaporation gas emission according to claim 3, further comprising:

a switching unit provided in the communication hole so as to switch communication between the negative pressure generation unit being in communication with the canister, and the canister being in communication with atmosphere, wherein the control unit controls operation of the switching unit before setting the reference pressure to open the canister to the atmosphere, and controls the operation of the switching unit at start of the purge process to provide communication between the negative pressure generation unit and the canister.

* * * * *